United States Patent [19]

Bollard

[11] Patent Number: 4,964,172

[45] Date of Patent: Oct. 23, 1990

[54] NURSING BLANKET

[76] Inventor: Jill W. Bollard, 945 Musket Dr., Lansdale, Pa., 19446

[21] Appl. No.: 366,611

[22] Filed: Jun. 15, 1989

[51] Int. Cl.[5] ..... A41D 1/20

[52] U.S. Cl. ..... 2/104; 2/207

[58] Field of Search ..... 2/206, 207, 174, 104, 2/171

[56] References Cited

U.S. PATENT DOCUMENTS

| | | | |
|---|---|---|---|
| 1,261,073 | 4/1918 | Van Raalte | 2/207 |
| 2,417,888 | 3/1947 | Schuster | 2/104 |
| 2,709,261 | 5/1955 | Kalensky | 2/207 |
| 3,141,176 | 7/1964 | Neumann | 2/207 |
| 4,004,294 | 1/1977 | Pinch | 2/104 |
| 4,031,566 | 6/1977 | Johnson | 2/104 |
| 4,106,122 | 8/1978 | Dodd | 2/104 |
| 4,468,816 | 9/1984 | Kaufer | 2/104 |
| 4,567,611 | 2/1986 | Kendrick | 2/104 |
| 4,631,754 | 12/1986 | Ryan | 2/104 |
| 4,697,287 | 10/1987 | Rose | 2/104 X |
| 4,712,251 | 12/1987 | Cobble | 2/104 X |
| 4,726,085 | 2/1988 | Antonio | 2/49 R X |

FOREIGN PATENT DOCUMENTS

| | | | |
|---|---|---|---|
| 990349 | 9/1951 | France | 2/207 |

*Primary Examiner*—Werner H. Schroeder
*Assistant Examiner*—Jeanette E. Chapman
*Attorney, Agent, or Firm*—Gerald Post

[57] ABSTRACT

A nursing blanket for use by a nursing mother to shield her breast from public view while feeding her infant. The blanket comprises a square of woven cloth with an elastic, garter-like loop affixed near one corner of the cloth. In use, the mother inserts her arm through the loop and pulls the loop up over the point of the shoulder thereby disposing the cloth down the length of the arm. She then cradles the infant in same arm and drapes a portion of the cloth over most of her chest including her breast and over the infant's head and upper body. She can then reach under the cloth to bare her breast and offer it to the infant. In this way she effectively screens her breast from view and is able to discretely nurse in public.

5 Claims, 1 Drawing Sheet

NURSING BLANKET

BACKGROUND OF THE INVENTION

1. Field of the Invention

The invention relates generally to a nursing blanket or tent draped over the outer garments for providing privacy to a nursing mother.

2. Description of the Prior Art

The nursing mother is frequently faced with the problem of feeding her infant when she is in a public area and, at the same time, avoiding exposure that may be objectionable.

There are many shielding devices and procedures currently available to the woman ranging from simply throwing a diaper or towel over her chest to articles of apparel such as aprons, vests and the like. Some of the articles of apparel are disclosed in U.S. Pat. Nos. 4,004,294 to Pinch; 4,031,566 to Johnson; 4,106,122 to Dodd; and 2,417,888 to Schuster. These are complex garments configured to facilitate the nursing procedure but offer very little privacy to the mother.

U.S. Pat. Nos. 4,567,611 to Kendrick and 4,631,754 to Ryan describe garments intended preclude exposure of the mother's breast but they only partially succeed. Neither of these devices offer concealment to a viewer situated above or to the side of the mother.

All the prior art devices cited are either costly garments because of complex tailoring, or bulky and not easily carried in a purse or other small container, or in capable of completely screening the mother from the public eye.

SUMMARY OF THE INVENTION

The present invention overcomes the limitations of the prior art. The principle object of this invention is to provide a blanket type covering for the nursing mother that will provide her with sufficient privacy to discreetly tend to the feeding of her infant while in public by avoiding potentially objectionable exposure.

A further object is to provide a device that will not accidentally dislodge or disarrange during use and will remain in place although the infant may be squirming.

A still further object is to provide a device that is useable by the mother for nursing from either breast.

A still further object is to provide a device that is simple in construction, having a low cost and having little bulk so that can be kept in a purse or other small container.

A still further object is to provide a device that allows the mother to remove the infant from the breast for burping or other needs while said device continues to cover the breast.

A still further object is to provide a device that allows the mother to easily see the baby (and have the baby see her) by simply lifting a portion of the blanket.

These and other objects are achieved by the preferred embodiment of the present invention which comprises a square cloth member that will be used to cover the mother's cradling arm and her breast as well as the infant's head and much of its upper body during nursing. The cradling arm is the arm that is the main support for the infant wherein the infant's head lies generally at the crook of the elbow. Attached to the cloth is a elastic garter-like loop sized to stretch over the cradling arm and then expand to snugly grip around the shoulder and armpit. This type of retention is more secure than supporting the cloth around the neck as disclosed in the Ryan patent and creates a superior visual blockage to passers-by than either Kendrick or Ryan. The elastic loop, so disposed, gives secure retention of the blanket in the desired position. Pinning the cloth to the shoulder portion of an outer garment is difficult for one person to do and does not provide an easily adjustable fastening. By using the described arm loop, the blanket quickly is positioned so that a portion of the cloth can easily be drawn over the nursing infant thereby concealing it and the mother's breast from view.

Having in mind the above and other objects that will be obvious from an understanding of the disclosure, the present invention comprises a combination and arrangement of parts illustrated to the presently preferred embodiments of the invention which are hereinafter set forth in sufficient detail to enable those persons skilled in the art to clearly understand the function, operation, construction, and advantages of it when read in conjunction with the accompanying drawing.

BRIEF DESCRIPTION OF THE DRAWING

The invention will be described in detail, by way of example, with reference to the accompanying drawing in which.

DESCRIPTION OF THE PREFERRED EMBODIMENT

Figure 1:
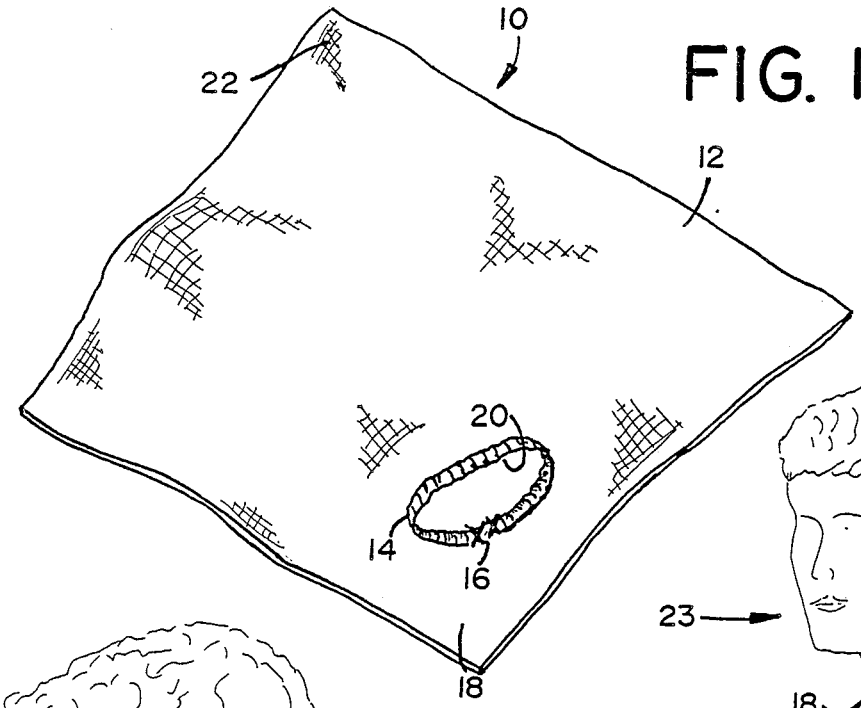
FIG. 1 is a pictorial view of the nursing blanket showing the cloth member and the elastic loop.

Referring to FIG. 1 of the drawing and in accordance with the principles of the invention, a nursing blanket 10 for affording privacy to the nursing mother is shown comprising a cloth member 12 having a generally square shape and an elastic loop 14 having a garter-like configuration for releasably retaining the cloth member 12 to the mother's arm. The loop 14 is affixed to the cloth member 12 by sewing at a point 16 on its periphery to a point on the cloth member 12 proximate to one corner 18 thereof. The cloth member can be made of many different light weight, soft and supple materials such as woven cotton or a cotton/polyester blend and measures approximately 30.5 inches (77.5 cm) on a side. The edges can be hemmed or have a fabric binding sewn thereon. The point of attachment of the loop is located proximate to the edge of the cloth or at about 8 inches (20.3 cm) from the edges defining corner 18. The elastic loop 14 is constructed of $\frac{3}{4}$ inches (1.9 cm) wide by 14 inches (35.5 cm) long elastic sewn to a fabric backing while the elastic is stretched resulting in the garter-like member when the ends are joined.

The loop 14 is affixed in an orientation wherein the opening 20 aligns with the diagonal defined by the corner 18 of the cloth member 12 and the opposing corner 22.

Figure 2:
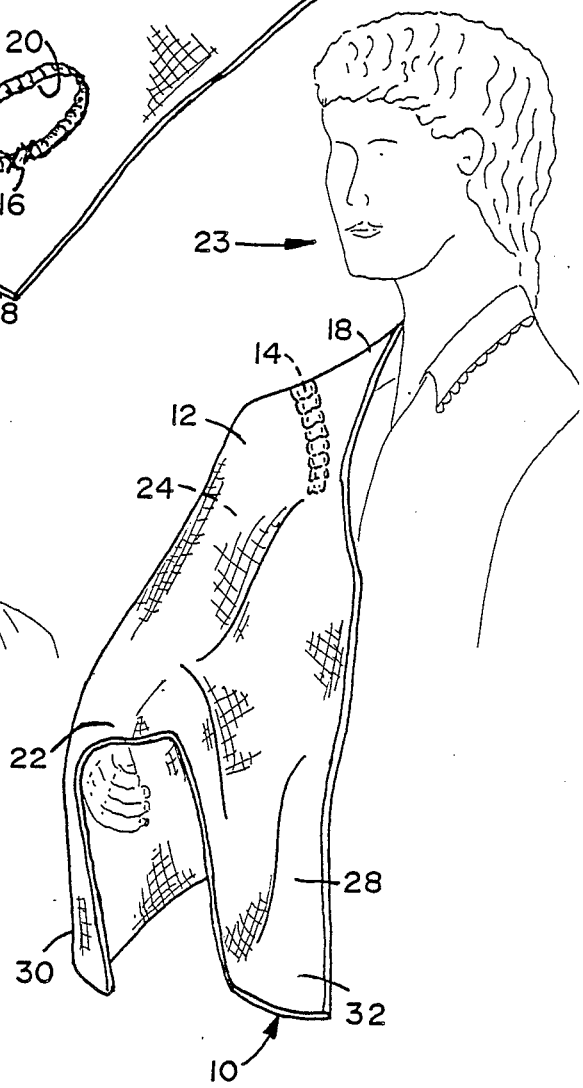
FIG. 2 is a pictorial view showing the blanket attached to the mother's cradling arm.

In use, the mother 23 would insert the arm 24 she intends to use to cradle her infant 26 through the loop opening 20 and draw the stretched loop 14 and attached cloth member 12 fully up the arm 24 and position the expanded loop 14 over the point of the shoulder and under the armpit as shown in FIG. 2. One corner 18 of the cloth member 12 would then fall near the mother's neck while the arm 24 would fall along the diagonal. A first portion 28 of the cloth member 12 comprising about one-half of the member 12 would hang between the arm 24 and the mother's body while a second portion 30 would hang over the back of the arm. The mother 23 then cradles the infant 26 in her arm 24 and under the fabric member 12 and brings the infant to the vicinity of her breast in position for suckling.

Figure 3:
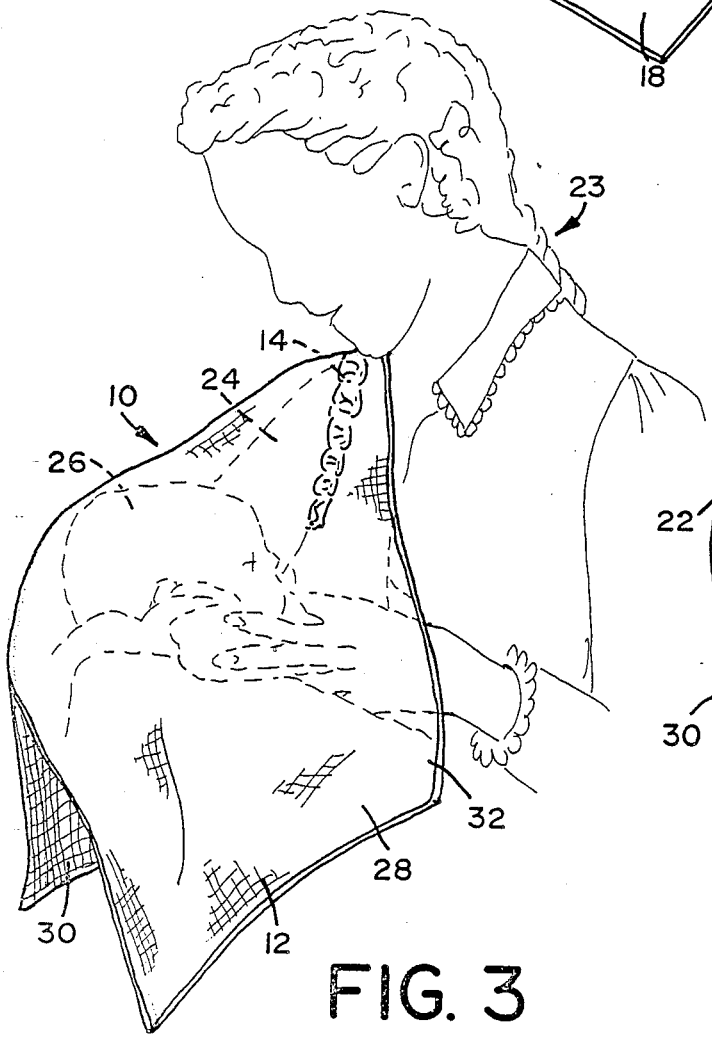
FIG. 3 is a pictorial view showing the blanket in use shielding the mother.

Referring now to FIG. 3, the first portion 28 of the cloth member 12 is draped to cover the baby's head and upper body and also the mother's chest including the feeding breast. The cloth, as configured, extends lower than the arm and breast. The first portion 28 of the cloth member thereby completely conceals the chest including the breast. The second portion 30 drapes over the arm and hangs down around the side of the mother. In this way, the breast is shielded from view from all directions including the front, sides and from above. The mother can easily lift a corner 32 to peek at the infant from time to time as desired. Public feeding is no longer a concern since the nursing blanket 10 herein described screens the nursing procedure from view.

While the preferred embodiments of the invention are described, it will be understood that the invention is in no way limited by these embodiments.

I claim:

1. A nursing blanket to be used by a nursing mother to screen her breast as well as the head of the feeding infant from public view comprising:

a cloth member having a first portion having one surface thereof disposed toward the mother and configured to drape over and cover the breast of the mother, the arm cradling the infant and the infant's head and a second portion capable of covering the mother's side and portions of her back while the infant is cradled in the mother's arm and in position for nursing; and means for releasably retaining said cloth member to said arm to maintain the member in the draped position said means disposed entirely on said one surface thereby obstructing the viewing of the breast from all aspects and screening her breast from the public eye thus affording privacy to the mother while nursing.

2. The nursing blanket as recited in claim 1, wherein the means for releasably retaining said cloth member comprises an elastic loop expandedly positionable over the nursing arm and stretchable over the point of the shoulder, said loop affixed at a peripheral portion thereof proximate to an edge of the cloth member wherein the arm inserted therethrough aligns with a midline of the cloth dividing the cloth into said first and second portions.

3. The nursing blanket as recited in claim 2, wherein said cloth member is generally square in shape.

4. The nursing blanket as recited in claim 3, wherein said cloth member comprises a woven cotton fabric and measures approximately 31.5 inches (77.5 mm) on a side.

5. A method of discreetly nursing an infant comprising the steps of:

providing a nursing blanket comprising a cloth member having first and second screening portions and further including an elastic loop expandedly receivable of the mother's cradling arm, said loop affixed at one point thereof to one surface of said cloth member proximate to an edge thereof;

passing said elastic loop over the arm and drawing same over the point of the shoulder allowing said first and second portions of the cloth member to drape over the inner and outer portions of the arm respectively;

cradling the infant in mother's arm and bringing it to the suckling position;

draping said first portion of the cloth member over a portion of the mother's chest including the nursing breast and also including the infant's head and upper body while said second portions hangs over the arm along the side of the mother thereby allowing the mother to reach under said cloth to adjust her outer garments giving the infant access to the breast while effectively screening same from the public view.

* * * * *